US010736195B2

(12) United States Patent
McCarroll et al.

(10) Patent No.: US 10,736,195 B2
(45) Date of Patent: Aug. 4, 2020

(54) MATCHED FILTER TECHNIQUES CONFIGURED TO FIRE LED USING A SLOPED RESPONSE

(71) Applicant: Maxim Integrated Products, Inc., San Jose, CA (US)

(72) Inventors: Benjamin John McCarroll, Portland, OR (US); Yaohua Yang, West Linn, OR (US)

(73) Assignee: Maxim Integrated Products, Inc., Palo Alto, CA (US)

( * ) Notice: Subject to any disclaimer, the term of this patent is extended or adjusted under 35 U.S.C. 154(b) by 0 days.

(21) Appl. No.: 16/251,590

(22) Filed: Jan. 18, 2019

(65) Prior Publication Data

US 2019/0246470 A1 Aug. 8, 2019

Related U.S. Application Data

(60) Provisional application No. 62/627,549, filed on Feb. 7, 2018.

(51) Int. Cl.
*H05B 45/44* (2020.01)
*H05B 45/00* (2020.01)
(Continued)

(52) U.S. Cl.
CPC ..... *H05B 45/44* (2020.01); *H05B 45/00* (2020.01); *H05B 45/10* (2020.01); *H05B 47/10* (2020.01)

(58) Field of Classification Search
CPC .. G01J 3/14; G01J 3/28; G01J 3/4406; G01N 21/4738; G01N 21/64; G01N 21/645;
(Continued)

(56) References Cited

U.S. PATENT DOCUMENTS 6,229,856 B1 * 5/2001 Diab ..... A61B 5/14551 375/316
7,154,599 B2 12/2006 Adams et al.
(Continued)

FOREIGN PATENT DOCUMENTS

CN 104243034 A 12/2014

OTHER PUBLICATIONS

Okawa (2nd order CR filter Design tools); http://sim.okawa-denshi.jp/en/CRCRkeisan.htm (Year: 2009).*
(Continued)

*Primary Examiner* — Renan Luque
(74) *Attorney, Agent, or Firm* — North Weber & Baugh LLP

(57) ABSTRACT

An electronic device comprising a matched filter to drive a LED module is disclosed. The matched filter receives an incoming rectangular pulse and outputs a modulated driving signal to drive the LED module. The optical output from the LED is captured by an optical sensor and converted to electrical signal for analysis. A decimation filter couples to the optical sensor in an effort of reducing sampling rate and quantization noise of the converted electrical signal. The modulated driving signal output from the matched filter keeps the LED current, thus LED light, matching the time-mirrored impulse response of the decimation filter to obtain or approach a theoretical maximum signal-to-noise (SNR) at a fixed amount of power.

17 Claims, 3 Drawing Sheets

(51) Int. Cl.
*H05B 45/10* (2020.01)
*H05B 47/10* (2020.01)

(58) Field of Classification Search
CPC ..... H04B 10/1141; H04B 10/116; H04L 25/4904; H05B 37/0245; H05B 37/0254; H05B 37/0272; H05B 33/0824; H05B 33/0842; H05B 37/02; H05B 45/44; H05B 45/00; H05B 45/10; H05B 47/10; H03H 17/0254; H03H 17/0294
See application file for complete search history.

(56) References Cited

U.S. PATENT DOCUMENTS 8,253,353 B2 8/2012 Baggen et al.
8,315,684 B2 * 11/2012 Petersen ..... A61B 5/14551 600/322
8,508,330 B1 * 8/2013 Godbole ..... H05B 33/0863 340/12.34
2008/0033266 A1 * 2/2008 Diab ..... A61B 5/14546 600/336
2015/0018649 A1 * 1/2015 Lisogurski ..... H05B 33/0842 600/323
2015/0103360 A1 * 4/2015 Addison ..... G01B 11/14 356/614
2016/0285587 A1 * 9/2016 Noest ..... H04L 25/06
2018/0014124 A1 * 1/2018 Straeussnigg ..... H03G 3/3005

OTHER PUBLICATIONS

Pandu, Design and VLSI Implementation of a Decimation filter for Hearing Aid Applications. 2007. National Institute of Technology (Year: 2007).*
Vendra, Decimation Filter for the VACS Platform. 2006. The Royal Institute of Technology (Year: 2006).*

* cited by examiner

MATCHED FILTER TECHNIQUES CONFIGURED TO FIRE LED USING A SLOPED RESPONSE

CROSS REFERENCE TO RELATED APPLICATION

The application claims priority under 35 U.S.C. § 119(e) to Provisional Patent Application No. 62/627,549, entitled "MATCHED FILTER TECHNIQUES CONFIGURED TO FIRE LED USING A SLOPED RESPONSE," naming as inventors Benjamin John McCarroll, and Yaohua Yang, and filed Feb. 7, 2018, the subject matter of which is hereby incorporated herein by reference in its entirety.

BACKGROUND

A. Technical Field

The present disclosure relates generally to matched filter and more particularly to matched filters in LED drivers.

B. Background of the Invention

Light emitting diode (LED) has wide applications in various industries. Compared to traditional incandescent light sources, LEDs have many advantages, such as lower energy consumption, longer lifetime, improved physical robustness, smaller size, lower cost, and faster switching.

LEDs have been used widely in consumer electronics, wearable electronics or biosensors, such as a pulse oximeter. It is very important that the LEDs are operated at high power efficiency to deliver long life-span for batteries, which have limited energy storage.

In heart-rate and blood oxygen (SPO2) measurement applications, LED driver consumes a significant amount of power. A typical pulse oximeter uses an electronic processor and a pair of small LEDs to emit red and/or infrared light through a translucent part of a user body, such as a fingertip, an earlobe or a toe. An optical sensor, such as a photodiode, incorporated within the pulse oximeter captures transmitted light (that is not absorbed) for analysis.

The LED module of a typical pulse oximeter is normally driven with a rectangular pulse, which does not always match a time-mirrored impulse response of filters associated with the photodiode. Consequently, the oximeter may not operate to achieve the theoretical maximum signal-noise-ratio (SNR) for a fixed amount of power; the transmit and receive shapes may NOT be matched.

It would be desirable to drive the LED with an optimized waveform to achieve a high SNR under limited amount of power.

SUMMARY OF THE INVENTION

Embodiments of the invention relate to matched filter to drive the LED with desired waveform for a high SNR and method for its implementation.

In various embodiments, an electronic device comprising a matched filter to drive a LED module is disclosed. The matched filter receives an incoming rectangular pulse and outputs a modulated driving signal to drive the LED module. The optical output from the LED is captured by an optical sensor, such as a photodiode, for analysis. In embodiments, the optical sensor comprises a decimation filter in an effort of reducing sampling rate and quantization noise of the captured signal. The modulated driving signal output from the matched filter maintains a correlation between the modulator and LED currents and approximates a mirrored impulse response of the decimation filter.

In some embodiments, the decimation filter is a third order decimation filter and therefore has a quadradic impulse response. The matched filter is a passive filter which is able to modulate a rectangular pulse into a modulated signal with good approximation to the quadradic impulse response. The matched filter only comprises passive components, such as resistor and capacitor, and therefore is simple for implementation.

In some embodiments, the matched filter is a high-pass Resistor-Capacitor (RC) filter comprising a first resistor, a second resistor, and a capacitor. The first resistor and the second resistor both have one end grounded, and the other end coupled to the capacitor. The matched filter receives the rectangular pulse on the first resistor side and outputs the modulated signal from the second resistor side. In embodiments, the second resistor has a resistance higher than the first resistor. Furthermore, at least one of the second resistor and the capacitor is adjustable or programmable for a desirable modulated signal.

In some embodiments, the desired modulated signal is achieved by synthesizing a desired digital waveform, converting the synthesized digital waveform into an analog signal via a digital/analog converter (DAC), and then driving the LED module using the analog signal.

Various modifications of the present disclosure will become apparent from the detailed description, the claims and the drawings. The detailed description and specific examples are intended for purposes of illustration only and are not intended to limit the scope of the disclosure

BRIEF DESCRIPTION OF THE DRAWINGS

Reference will be made to exemplary embodiments of the present invention that are illustrated in the accompanying figures. Those figures are intended to be illustrative, rather than limiting. Although the present invention is generally described in the context of those embodiments, it is not intended by so doing to limit the scope of the present invention to the particular features of the embodiments depicted and described.

One skilled in the art will recognize that various implementations and embodiments of the invention may be practiced in accordance with the specification. All of these implementations and embodiments are intended to be included within the scope of the invention.

DETAILED DESCRIPTION OF THE PREFERRED EMBODIMENTS

In the following description, for the purpose of explanation, specific details are set forth in order to provide an understanding of the present invention. The present invention may, however, be practiced without some or all of these details. The embodiments of the present invention described below may be incorporated into a number of different electrical components, circuits, devices, and systems. Structures and devices shown in block diagram are illustrative of exemplary embodiments of the present invention and are not to be used as a pretext by which to obscure broad teachings of the present invention. Connections between components within the figures are not intended to be limited to direct connections. Rather, connections between components may be modified, re-formatted, or otherwise changed by intermediary components.

When the specification makes reference to "one embodiment" or to "an embodiment", it is intended to mean that a particular feature, structure, characteristic, or function described in connection with the embodiment being discussed is included in at least one contemplated embodiment of the present invention. Thus, the appearance of the phrase, "in one embodiment," in different places in the specification does not constitute a plurality of references to a single embodiment of the present invention.

Various embodiments of the invention are used for a matched filter for LED drivers and method for its implementation. The matched filter maintains a correlation between the modulator and LED currents and approximates a mirrored impulse response of a decimation filter within a LED light sensing circuit.

Figure 1:
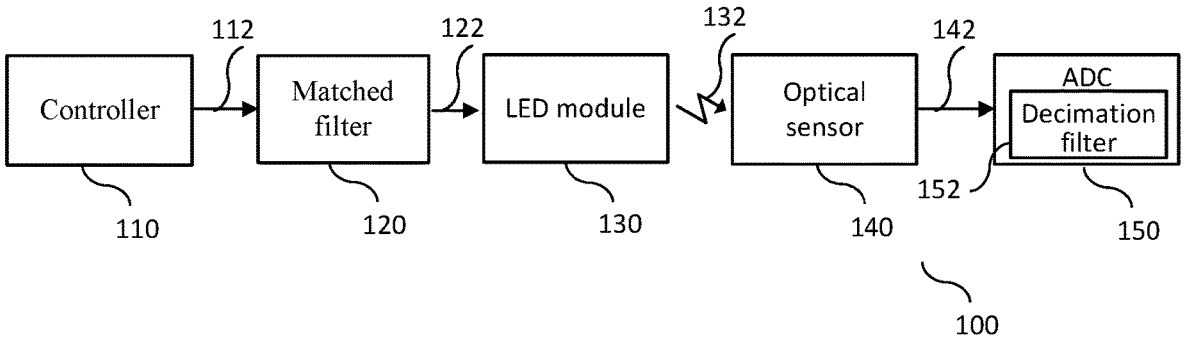
FIG. 1 is a block diagram of an electronic device according to various embodiments of the invention.

FIG. 1 shows a block diagram of an electronic device 100 according to various embodiments of the invention. The electronic device 100 comprises a controller 110, a matched filter 120, a LED module 130, an optic sensor 140, and an analog-to-digital converter (ADC) 150. The electronic device 100 may be a portable electronic device, a wearable biosensor, such as a wearable heart-beat sensor, a SpO2 (peripheral capillary oxygen saturation) sensor, etc. In embodiments, the electronic device 100 may also be a complement integrated within a smartphone, or a wearable device. The matched filter 120 receives a driving signal 112 from the controller 110 and outputs a modulated driving signal 122 to drive the LED module 130 for desired LED light 132 output. The optic sensor 140, such as a photodiode, senses the LED light 132 and outputs an electrical signal 142 for the ADC 150 to process or analyze.

The ADC 150 converts the electrical signal 142 into a digital signal with desired bits rate and resolution. In embodiments, the ADC 150 may implement Delta-sigma ($\Delta\Sigma$) modulation for the analog-to-digital conversion. The ADC 150 may further incorporate decimation structure, such as a decimation filter 152, for desired signal processing performance. The decimation is a process of reducing the sampling rate of a signal, by an integer factor, a rational factor, or an irrational factor. Besides down-sampling and thus reducing the clock rate, decimation filter also performs to remove the out-of-band signals and noise. A decimation filter may be a 1st-order, 2nd-order, 3rd-order, or even higher order filter. In embodiments, the decimation filter may be a sin c filter or a Cascaded Integrator Comb filter (CIC).

A decimation filter has a specific impulse response depending on the order of the decimation filter. For example, a 1st-order filter impulse response has a rectangular shape; a 2nd-order filter has a triangular (linear) impulse response; while a 3rd-order filter impulse response has a quadradic response. For power efficiency, it is desirable to have the LED current (thus LED light) match the time-mirrored impulse response of the decimation filter to obtain or approach a theoretical maximum signal-to-noise ratio (SNR) at a fixed amount of power.

In embodiments, the driving signal 112 from the controller 110 is a square rectangular pulse signal at desired or predetermined frequency, for ease of design and implementation. The matched filter 120 receives the square rectangular pulse signal and outputs a modulated driving signal 122 to drive the LED module 130 for desired LED light 132 output. In embodiments, the square rectangular pulse signal may be a current signal or a voltage signal.

Figure 2:
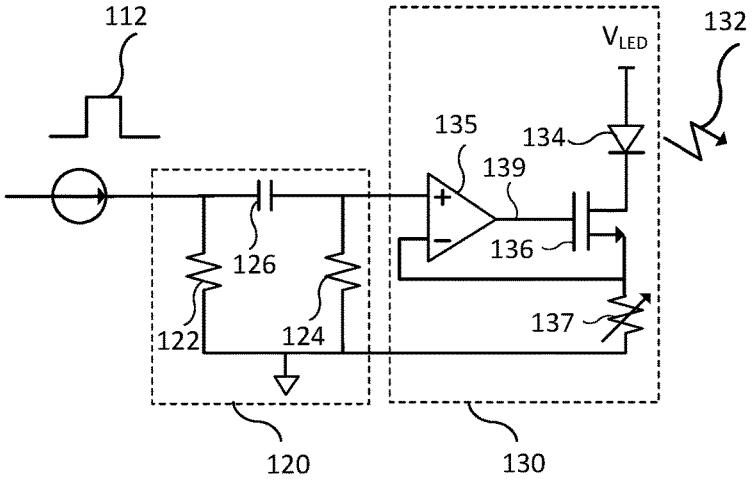
FIG. 2 is a schematic diagram of a matched filter with a LED module according to various embodiments of the invention.

FIG. 2 is a schematic diagram of a matched filter with a LED module according to various embodiments of the invention. As shown of the embodiment in FIG. 2, the matched filter 120 is a passive filter containing no active components. In embodiments, the passive filter is a high-pass Resistor-Capacitor (RC) filter comprising a first resistor 122, a second resistor 124, and a capacitor 126. The first resistor 122 and the second resistor 124 both have one end grounded, and the other end coupled to the capacitor 126. The matched filter 120 receives the rectangular pulse on the first resistor side for initial decay and outputs the modulated signal from the second resistor side. In embodiments, the second resistor 124 has a resistance much higher than the first resistor 122. Furthermore, at least one of the first resistor 122, the second resistor 124, and the capacitor 126 is variable or programmable for a desirable modulated signal.

The LED module 130 comprises a LED 134, an operation amplifier (OA) 135, a controllable switch 136 and an adjustable resistor 137. The OA 135 receives the modulated signal from the matched filter on a positive input side and output a control signal 139 to control the switch 136, which may be a metal-oxide-semiconductor field-effect transistor (MOSFET) switch having a gate, a drain and a source. The switch 136 receives the control signal 139 on the gate for ON/OFF control. The switch 136 also couples to the adjustable resistor 137 on the source. The LED 134 couples between the drain side of the switch and a voltage source $V_{LED}$. The modulated signal from the matched filter controls the switch 136, and also shapes the current of the LED (or LED light). In embodiments, the $V_{LED}$ is provided by a booster converter, such that the LED voltage is controllable for even higher performance and efficiency.

One of ordinary skill in the art shall understand that the LED 134 may be a single LED or a LED string comprising a plurality of LEDs. The LED 134 may be a green LED, a red LED, an infrared LED, etc. The modulated signal from the matched filter may be used to drive one or more LED drivers. For example, a biosensor may use both red and infrared LEDs and measure the absorption of red and infrared light in the extremity. The difference in absorption between oxygenated and deoxygenated hemoglobin makes the calculation possible. Such variations are intended to be included within the scope of the invention.

One of ordinary skill in the art shall understand that FIG. 2 is only one embodiment of the matched filter and LED module. One skilled in the art will recognize that various modifications and embodiments of the matched filter and LED module may be practiced. The modifications may include additional components of the filter, different controllable switches, etc. All of these implementations and embodiments are intended to be included within the scope of the invention.

Figure 3:
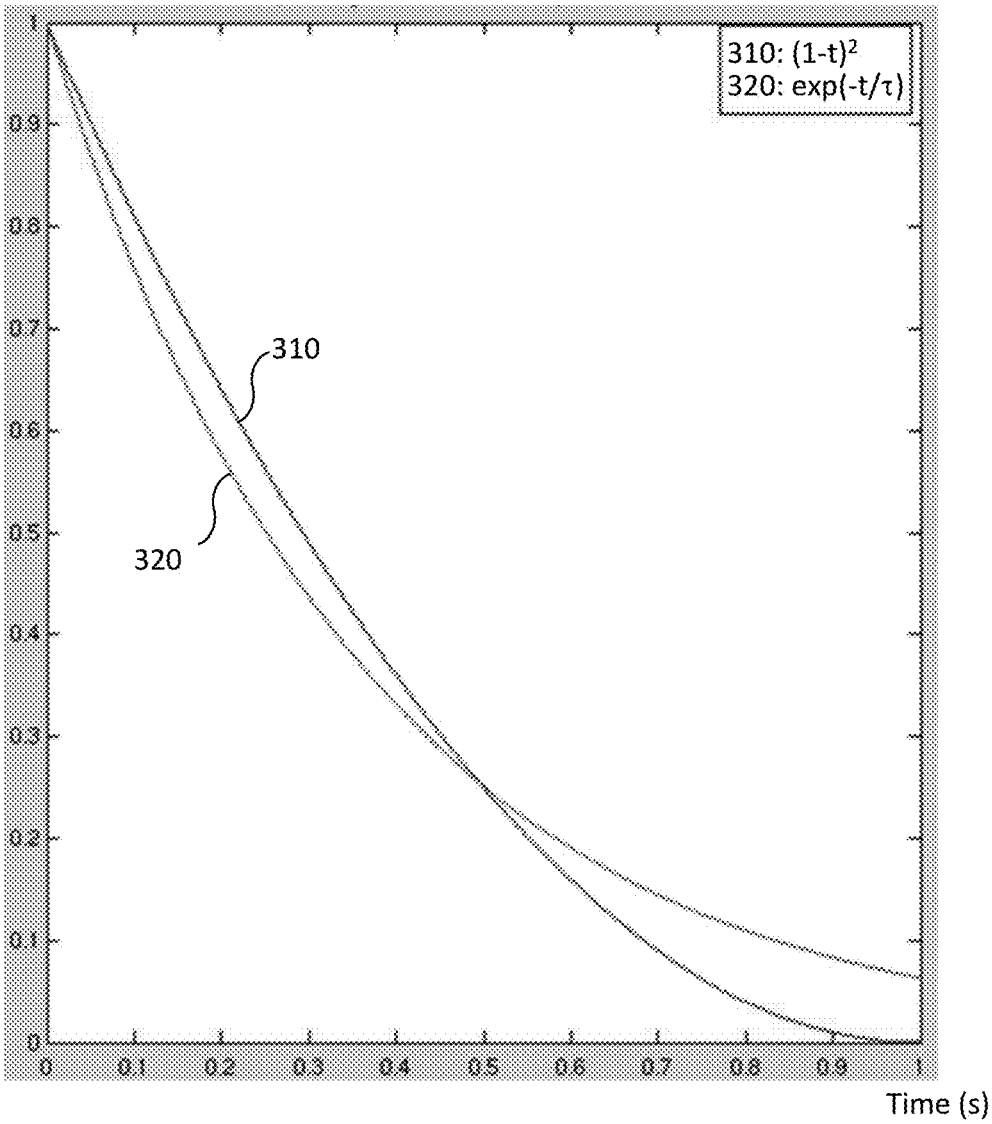
FIG. 3 is an approximation of a 3rd-order impulse response with a negative exponential according to various embodiments of the invention.

FIG. 3 is a simulation comparison between a 3rd-order impulse response with a negative exponential according to various embodiments of the invention. As shown in FIG. 3, line 310 represents an exemplary quadradic impulse response for a 3rd order decimation filter, line 320 is an RC decayed response ($\exp(-t/\tau)$, with $\tau=0.3623$), which approximates very well to the quadradic impulse response 310.

Using an RC decayed response to approximate 3rd order decimation impulse response enables a simple yet effective approach to improve SNR with a fixed amount of power thus the power efficiency, which is very beneficiary for wearable electronics application. An RC decayed response only requires passive components, such as resistors and capacitors, for the complementation, therefore is very cost-effective.

Figure 4:
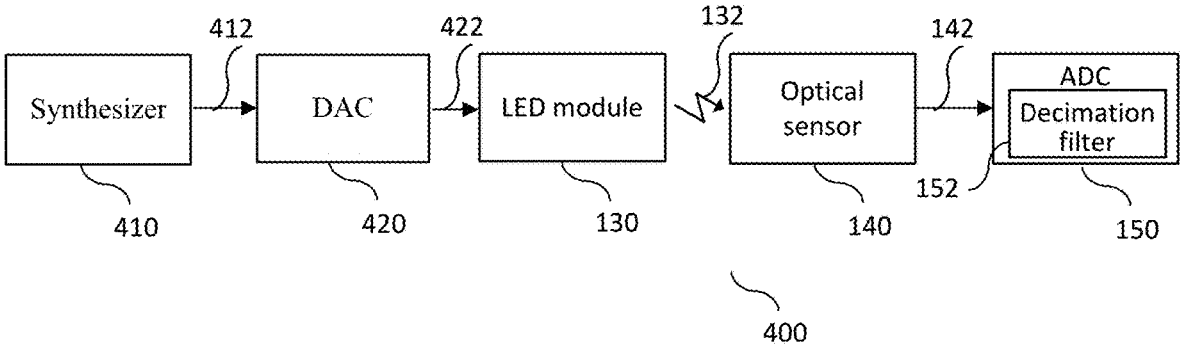
FIG. 4 is an alternative block diagram of an electronic device according to various embodiments of the invention.

FIG. 4 is an alternative block diagram of an electronic device according to various embodiments of the invention. The embodiment in FIG. 4 uses different approach from the embodiment shown in FIG. 1 to generate a desired modulated signal to diver the LED module 130. A synthesizer 410 synthesizes a desired digital waveform 412 according to the specification of the optical sensor 140 and the ADC 150 (including the decimation filter used within the ADC 150). The digital waveform 412 is then converted into an analog signal 422 via a digital/analog converter (DAC) 420. The analog signal 422 then drives the LED module for LED light control to obtain desired LED light pattern.

Such an approach of using synthesizer may add complication and would consume additional power. However, it provides enhanced flexibility to drive the LED module to provide controllable LED light pattern for different decimation filter configuration to achieve optimum SNR. Therefore, this approach may also be applicable to applications requiring high flexibility and versatility.

The foregoing description of the invention has been described for purposes of clarity and understanding. It is not intended to limit the invention to the precise form disclosed. Various modifications may be possible within the scope and equivalence of the application. It is intended that all permutations, enhancements, equivalents, combinations, and improvements thereto that are apparent to those skilled in the art upon a reading of the specification and a study of the drawings are included within the true spirit and scope of the present disclosure. It shall also be noted that elements of any claims may be arranged differently including having multiple dependencies, configurations, and combinations.

What is claimed is:

1. An electronic device comprising:

a light-emitting diode (LED) module comprising at least one LED;

a controller to generate a driving signal;

a filter coupled between the controller and the LED module, the filter receives the driving signal and outputs a modulated driving signal to drive the LED module such that the at least one LED generates an LED light output;

a photo sensor to sense the LED light and output an electrical signal; and an analog-to-digital converter (ADC) to receive the electrical signal for analog-to-digital conversion, the ADC comprises a decimation filter for reducing sampling rate during conversion, the LED light output has a pattern approximating an impulse response of the decimation filter.

2. The electronic device of claim 1 wherein the decimation filter is a third order decimation filter.

3. The electronic device of claim 1 wherein the driving signal is a rectangular pulse signal.

4. The electronic device of claim 3 wherein the filter is a passive filter.

5. The electronic device of claim 4 wherein the filter is a high-pass resistor-capacitor filter.

6. The electronic device of claim 5 wherein the filter comprises a first resistor to receive the rectangular pulse, a second resistor to output the modulated signal, and a capacitor coupled between the first resistor and the second resistor.

7. The electronic device of claim 6 wherein the second resistor has a resistance higher than the first resistor.

8. The electronic device of claim 6 wherein at least one of the second resistor and the capacitor is adjustable or programmable.

9. A method for generating and processing light-emitting diode (LED) light, the method comprising:

outputting a driving signal from a controller;

modulating, using a filter, the driving signal into a modulated driving signal to drive an LED module comprising at least one LED such that the at least one LED generates an LED light output;

sensing, at a photo sensor, the LED light output to generate an electrical signal; and receiving, at an analog-to-digital converter (ADC), the electrical signal for analog-to-digital conversion, the ADC comprises a decimation filter for reducing sampling rate during the conversion, the LED light output has a pattern approximating an impulse response of the decimation filter.

10. The method of claim 9 wherein the driving signal is a rectangular pulse signal.

11. The method of claim 10 wherein the decimation filter is a sin c filter or a Cascaded Integrator Comb filter.

12. The method of claim 10 wherein the decimation filter is a third order decimation filter.

13. The method of claim 12 wherein the filter is a high-pass resistor-capacitor (RC) filter.

14. The method of claim 13 wherein the RC filter has an RC decayed response to approximate the impulse response of the third order decimation filter.

15. The method of claim 13 wherein the RC filter comprises a first resistor to receive the rectangular pulse, a second resistor to output the modulated signal, and a capacitor coupled between the first resistor and the second resistor.

16. The method of claim 15 wherein the second resistor has a resistance higher than the first resistor.

17. The method of claim 15 wherein at least one of the second resistor and the capacitor is adjustable or programmable.

* * * * *